US006126391A

United States Patent [19]

Atraghji et al.

[11] Patent Number: 6,126,391

[45] Date of Patent: Oct. 3, 2000

[54] FLUID FLOW MACHINE

[76] Inventors: Edward Atraghji, 4689 Limebank Rd., Gloucester, Ontario, Canada, K1X 1E7; Rajendra P. Gupta, 9 Veery Lane, Gloucester, Ontario, Canada, K1J 8X4

[21] Appl. No.: 09/283,207

[22] Filed: Apr. 1, 1999

[51] Int. Cl.[7] ..... F01D 5/14

[52] U.S. Cl. ..... 415/115; 415/92; 415/199.2; 416/197 R; 416/235

[58] Field of Search ..... 415/115, 173.5, 415/92, 90, 199.1, 199.2; 416/197 R, 235, 237

[56] References Cited

U.S. PATENT DOCUMENTS 4,029,431 6/1977 Bachl .
5,704,764 1/1998 Chupp et al. ..... 416/97 R
5,820,339 10/1998 Trojahn ..... 415/202
5,845,757 12/1998 Csonka ..... 192/105 BA

*Primary Examiner*—Edward K. Look
*Assistant Examiner*—Liam McDowell

[57] ABSTRACT

A fluid flow device is described. A rotor of the fluid flow device has one or more bubbles such as open-ended scoop cups in a rotor disc. The rotor is located in a shroud. In the case of a compressor, the rotor is driven by power and upon rotation, scooping action of the scoop cups generate fluid flow through the rotor. In a power plant configuration, high speed fluid flow drives the rotor and the power is generated on its shaft. In another embodiment, a stator is also provided in the shroud. The stator also has one or more inlet cups and outlet cups to produce desired fluid flows through the stator. In further embodiments, multi-stage fluid flow devices are described in which one or more rotors and stators are alternately located in the shroud which is substantially axially symmetrical.

31 Claims, 12 Drawing Sheets

FLUID FLOW MACHINE

FIELD OF THE INVENTION

The invention generally resides in the field of fluid flow machines and, in particular, it is directed to such a machine in which a specially designed rotor permits exchange of energy between a flowing fluid and the rotating rotor.

BACKGROUND OF THE INVENTION

Fluid flow machines such as axial or transversal compressors are the most efficient and compact devices for compressing fluid or generating a fluid flow with high volumetric throughput. Similarly fluid turbines are also very efficient power plants for converting energy of flowing fluid to drive a rotary power shaft. However, they are also the most expensive and intricate equipment to design, build and test. This limits their application to very special instances such as aircraft jet engines, industrial gas compressors, pipeline transports and others. Design of existing fluid flow machines are such that they cannot be built at low enough cost to be used in many environmentally friendly applications. One such desirable application is in the area of refrigeration requiring vacuum vapour compressors with large volumetric throughput when using water as a refrigerant.

Conventional axial fluid flow machines such as air compressors use multiple stages of rotor and stator disc pairs arranged alternately in a coaxial configuration inside a shroud. Each rotor/stator disc comprises multiple blades mounted on a center hub. In each stage the fluid entering the rotor is compressed and moved along towards the stator disc where further compression may take place along with redirecting of the fluid for optimum entry into the next downstream rotor.

In multi-stage machines, the rotors driven by a power source compress as well as impart high velocity to the contact fluid that velocity is then converted into additional pressure by the stators to progressively raise the pressure from stage to stage. The back flow is minimized by providing very tight clearances and labyrinth seals between the shroud and the rotors and between rotors shaft and stators. In the case of turbine power plants, the contact fluid is imparted high pressure by mechanisms such as combustion, ignition, or some other energy source. The contact fluid under pressure drives a rotor or rotors which is used as a source of power, such as electrical generators, engines, etc.

The blades are profiled and dimensioned to run at particular Mach number and Reynolds number conditions for optimum performance. With the evolution of the technology, it is recognized that the two important factors which determined the improvement in performance are blade aspect ratio and tip to shroud clearance. As both are reduced, considerable improvement in stage pressure ratio is realized.

Blade design is a complex art. Each individual blade acts like a cantilever wing which can flex in torsion as well as in bending. Deviation from the ideal flow direction can cause aerodynamic stall of the blade leading, possibly, to what is commonly known as surge condition. This latter phenomenon can cause blade vibration which may result in the structural failure of a blade totally destroying the entire compressor.

In U.S. Pat. No. 4,029,431 Jun. 14, 1977, Bachl describes a fluid flow machine which includes a combination of rotating and non-rotating wheels. Each wheel has fluid flow channels which are shaped and located in such a way that upon rotation of wheels, desired fluid flows are created. The shapes and locations of channels are carefully designed to direct the fluid flow medium to have a transverse and an axial component relative to the axis of rotation of the rotating wheels. It should however be recognized that such shapes and locations of channels require complicated design and manufacturing procedures.

The current invention completely dispenses with the individual blade concept in favour of a disc with open narrow bubbles, acting as scoops, formed directly into the disc. The disc is housed in a shroud and is rotatable about an axis which is substantially coaxial with the shroud. The shroud is cylindrical in shape in some embodiments but it could be of any symmetrical shape such as frustum, stepped frustum etc. The bubbles are arranged to intercept the fluid and pass it through the openings as they rotate integrally with the disc.

OBJECTS OF INVENTION

It is therefore an object of the invention to provide a fluid flow device which is simple and economical in construction.

It is another object of the invention to provide a fluid flow device which is rugged in construction.

It is yet an object of the invention to provide a fluid flow device which includes a rotor having bubbles arranged near its perimeter.

It is a further object of the invention to provide a fluid flow device of a multi-stage construction in which rotors and stators are arranged alternately in a shroud, the rotors and stators having bubbles near their perimeters.

It is still an object of the invention to provide a fluid flow device in which the rotor and/or the stator are made by pressing and attaching two or more discs or plates together.

SUMMARY OF INVENTION

Briefly stated, the invention is directed to a fluid flow device for converting power between a fluid flow and a rotor. According to one aspect, the fluid flow device of the invention comprises a shroud which has a fluid inlet at one end and a fluid outlet at the other end and defines a general direction of a fluid flow from the fluid inlet to the fluid outlet. The device further includes a central shaft located substantially coaxially with the shroud and a rotor integrally attached to the central shaft for rotation therewith within the shroud in a substantially fluid tightness fashion. The rotor has one or more open-ended scoop cups on an upstream surface and near the circumference of the rotor, each open-ended scoop cup defining a fluid passage through the rotor. The open-ended scoop cups are shaped and sized for converting power between the fluid flow and the rotor.

According to a further aspect, the invention is directed to a fluid flow device for generating a fluid flow. The device further includes a power source for rotating the rotor about the central shaft. The scoop cups are shaped and sized in such a way that upon rotation of the rotor in one direction, the fluid flow is generated through the shroud.

According to yet another aspect, the fluid flow device of the invention comprises further an energy source for generating the fluid flow in the shroud, the energy source including any of gas combustion, explosion, hydrostatic and electrical potential. The scoop cups are shaped and sized in such a way for capturing power from the fluid flow to drive the rotor and the central shaft.

DETAILED DESCRIPTION OF PREFERRED EMBODIMENTS OF INVENTION

Figure 1:
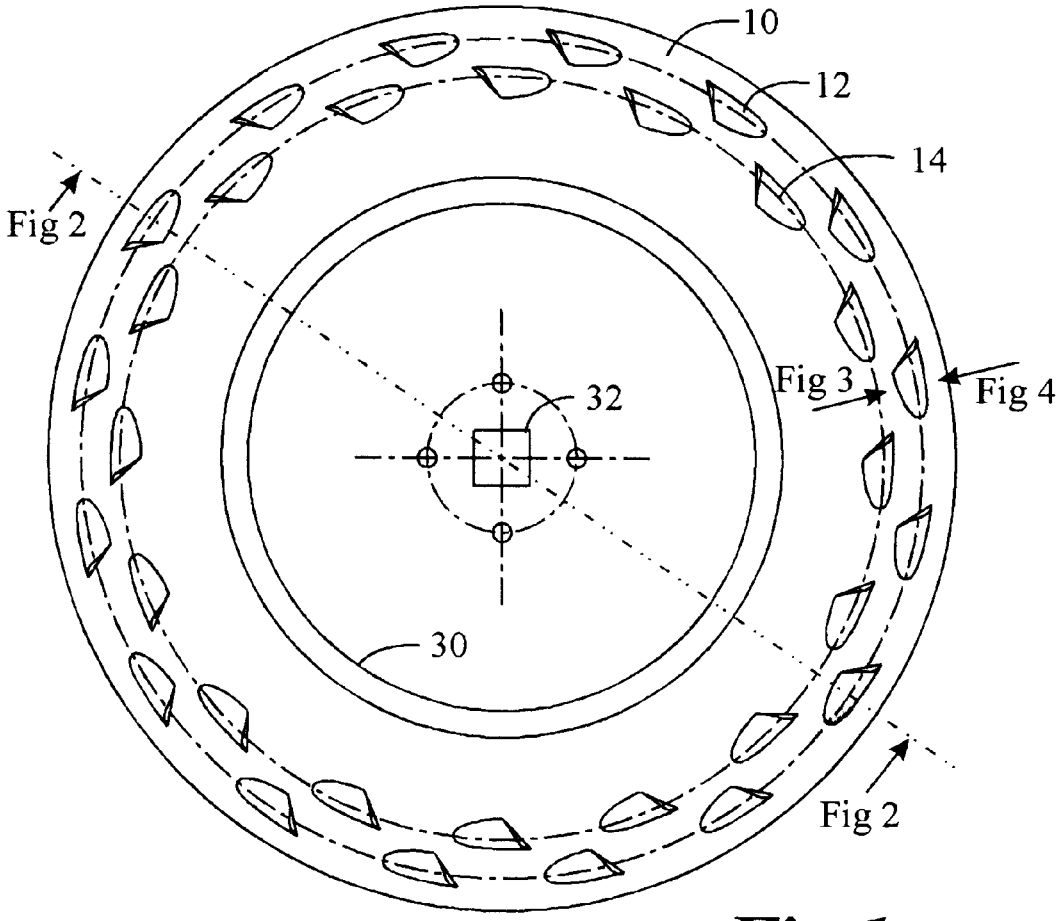
FIG. 1 is a frontal view of a rotor according to one embodiment of the invention.
Figure 2:
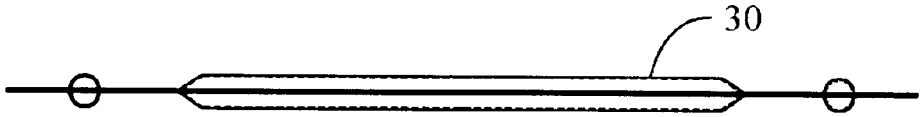
FIG. 2 is a side view of the rotor according to one embodiment.
Figure 3:
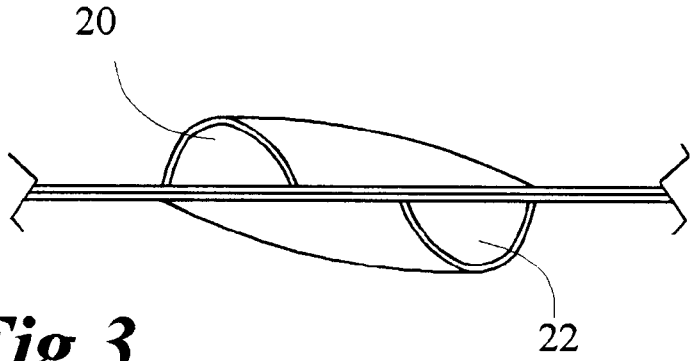
FIG. 3 is a side view of a pair of bubbles seen from the center of a rotor.
Figure 4:
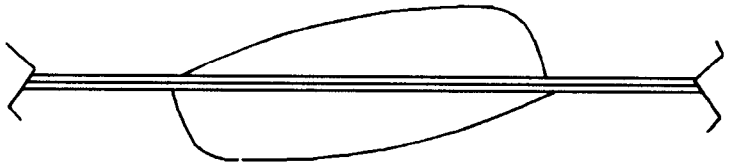
FIG. 4 is a side view of a pair of bubbles seen from the outer edge of a rotor.
Figure 5:
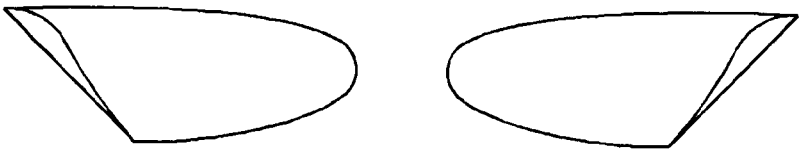
FIG. 5 is a top views of bubbles of a rotor.

FIG. 1 is a front view of a rotor 10 according to one embodiment of the invention. FIG. 2 is a side view of the rotor of FIG. 1 taken in the direction shown by arrows. In this embodiment, the rotor is housed in a cylindrical shroud (not shown), with its axis of rotation being substantially coaxial with the axis of the cylindrical shroud. The clearance between the shroud and the rotor should be as small as possible for good performance. A rotatable seal such as a labyrinth seal can be used here. The rotatable seal is a seal which permits rotation of an element while maintaining fluid tightness. In the embodiment shown in the figures, two rows of bubbles 12 and 14 are located near the perimeter of the rotor disc. Only one row of bubbles is visible in FIG. 2. The bubbles can be made by any suitable means but in this example they are pressed on the disc creating a protrusion which is open at broad end opening as well as at a surface. A single disc with bubbles on one side, i.e. on the upstream side is operable and these bubbles can be called scoop cups. For better performance and rigidity of structure, a construction depicted in FIGS. 3 and 4 would be preferable. In such an embodiment, the rotor is made of a pair of metal discs pressed together in surface contact with one another, each disc being provided with the bubbles protruding from one side of the surface. As the bubbles protruding on the upstream side are called scoop cups, those on the downstream side are called exhaust cups. FIGS. 3 and 4 are views taken from the directions indicated by arrows in FIG. 1. As shown in FIG. 3, each bubble has a protruding opening 20 and 22. The pair of metal discs are put together so that each bubble on one disc matches each one on the other disc and such pair of bubbles form a fluid flow channel from one protruding opening 20 to another 22. FIG. 5 shows the shapes of a scoop cup and an exhaust cup of the discs according to one embodiment of the invention in which the protruding openings are at angles relative to the radius of the disc for possibly more efficient scooping and exhausting actions. As shown in FIG. 1, the rotor is supported by a hub 30 on a rotating axis 32. The hub can be made by pressing the metal discs in the middle part to strengthen the discs.

Figure 6:
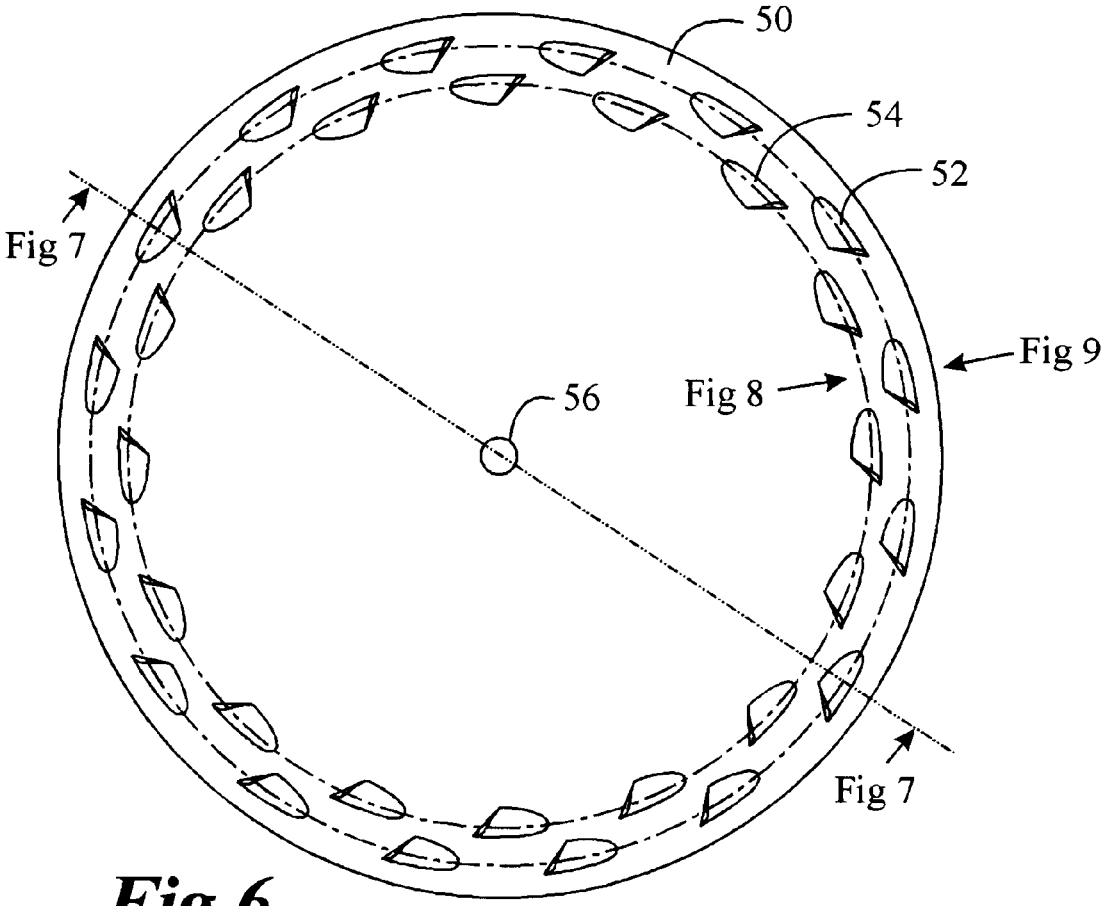
FIG. 6 is a frontal view of a stator according to one embodiment of the invention.
Figure 7:
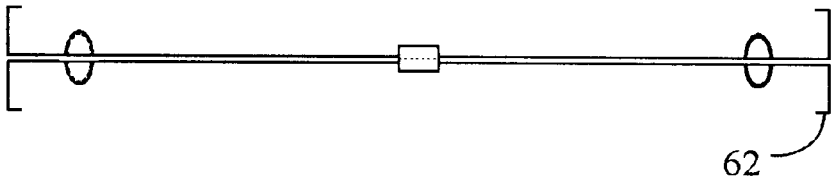
FIG. 7 is a side view of the stator according to one embodiment.
Figure 8:
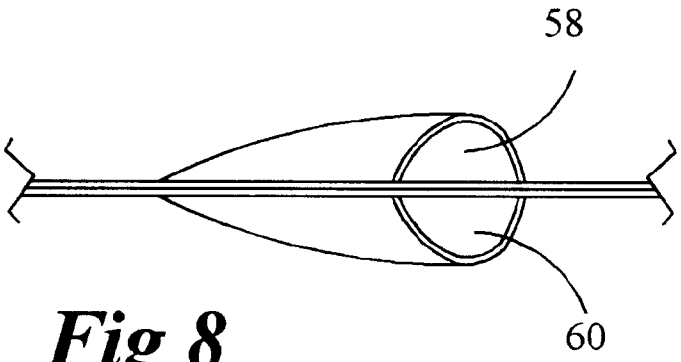
FIG. 8 is a side view of a pair of bubbles seen from the center of a stator.
Figure 9:
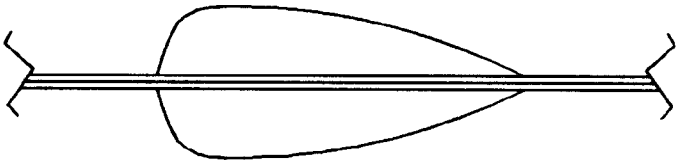
FIG. 9 is a side view of a pair of bubbles seen from the outer edge of a stator.
Figure 10:
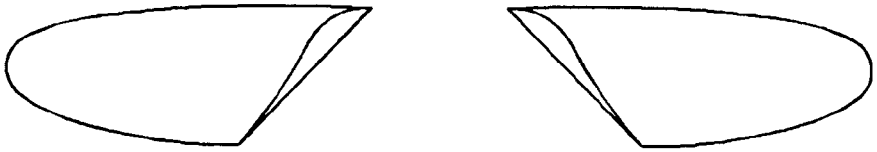
FIG. 10 is a top views of bubbles of a rotor.
Figure 11:
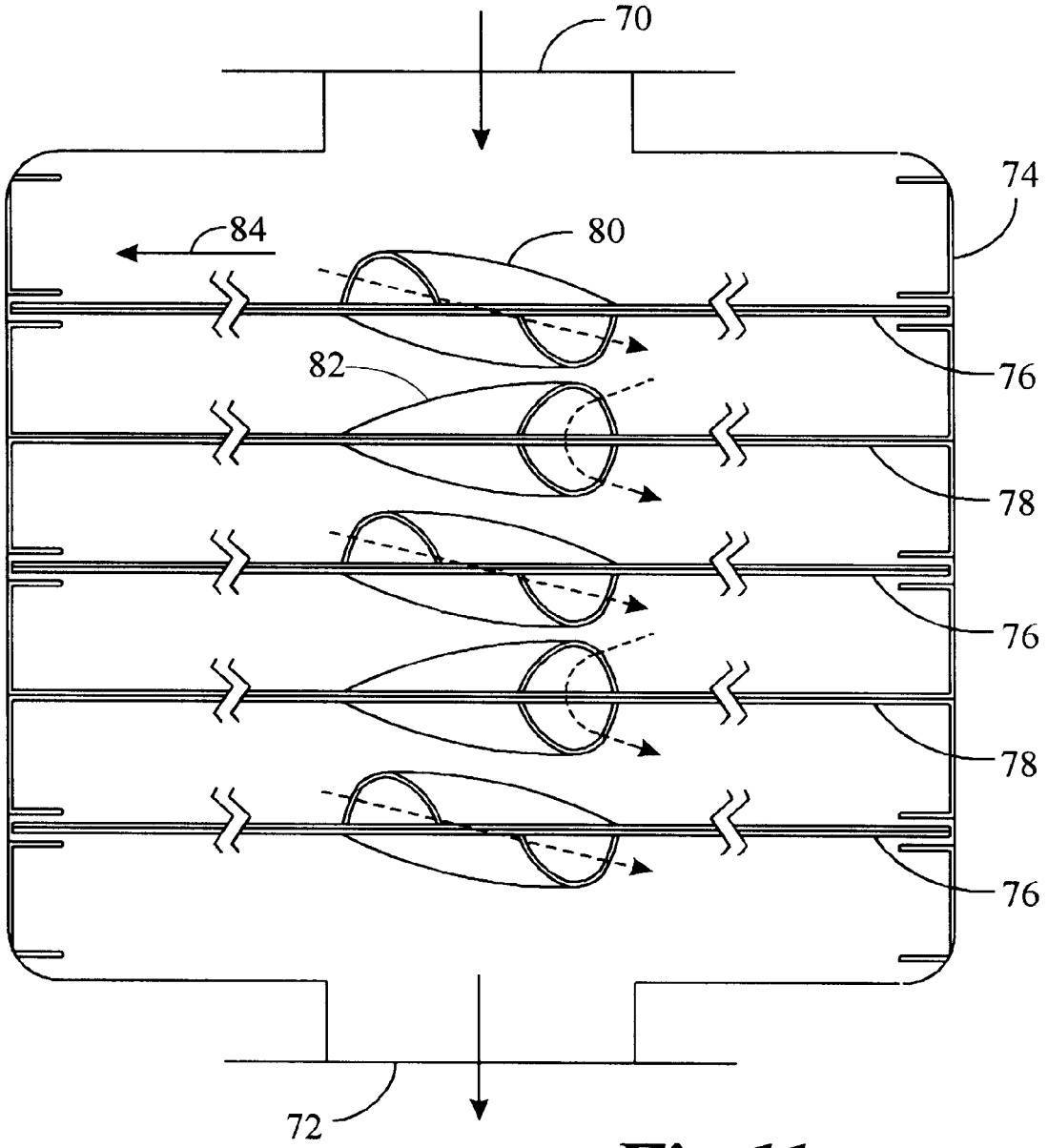
FIG. 11 is a side view of a three-stage axial fluid flow device according to another embodiment of the invention.
Figure 12:
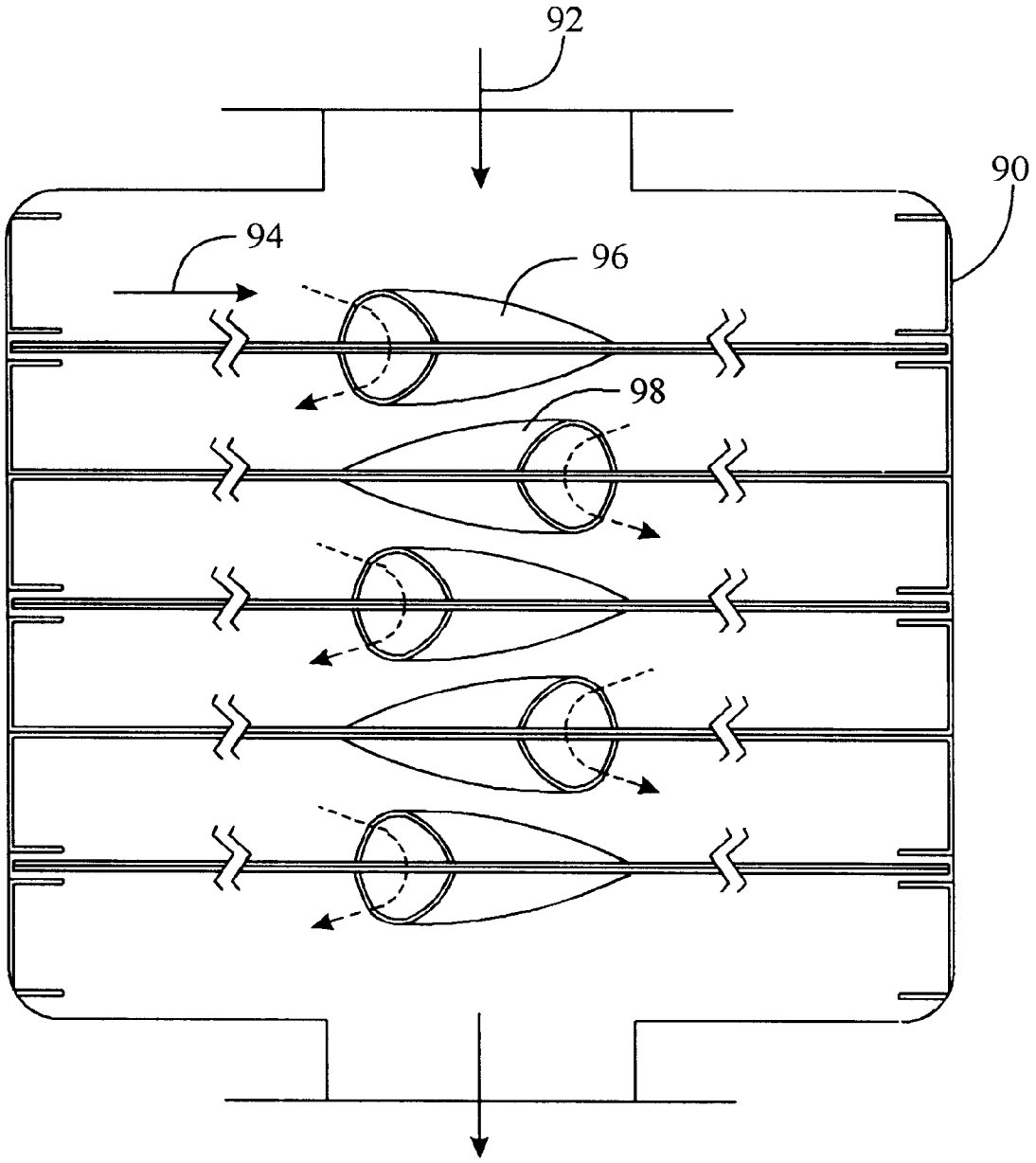
FIG. 12 is a side view of a three-stage axial fluid flow device according to a further embodiment of the invention This embodiment is configured as a power plant.

In another embodiment, a stator is also provided in the shroud, the rotor and stator being positioned coaxially in tandem. In a yet further embodiment, multiple of rotor-stator pairs are provided to form a multi-stage fluid flow device which will be described in detail below. FIGS. 6 and 7 are respectively a front and a side view of a stator 50 of one embodiment in which like the rotor shown in FIG. 1, two rows of bubbles 52 and 54 are positioned near the perimeter of the stator. Their relative locations are design specific. The rotor shaft passes through the stator and a suitable rotatable seal 56 is provided for minimizing the back flow of the fluid. Like the rotor, in one embodiment, the stator is also made by putting a pair of stator disc in surface contact to one another as shown in FIGS. 8 and 9. The bubbles are provided on each stator disc and a matching pair of bubbles (called inlet cup on the upstream side and outlet cup on the downstream side) form a fluid flow channel from one protruding opening 58 to another 60. FIG. 7 shows the stator perimeter 62 contoured to form a labyrinth seal, together with the next stator stage, for the rotor disc sandwiched in-between. This kind of arrangement is clearly visible in further embodiments of a multi-stage construction depicted in FIGS. 11 and 12. FIGS. 11 and 12 will be described in detail later. Referring further to FIGS. 8 and 9, unlike the rotor, the inlet cups and outlet cups on the stator are arranged in such a way to form the fluid flow channel which redirects the fluid flow downstream for efficient operation of the rotor of the following stage in a multi-stage device. FIG. 10 shows the shapes of an inlet cup and an outlet cup on the stator.

The bubbles in the rotor are arranged to intercept the maximum fluid volume as they rotate and force it towards the downstream stator. The bubbles in the stator, on the other hand, are arranged to arrest the swirl and to redirect the fluid flow appropriately towards the next downstream rotor. The location of bubbles are preferably near the perimeter of the rotor and stator but their relative locations can be varied for desired optimum operation. The size and shape of the bubbles, the number of bubbles in a row and the number of rows are also all design specific and can be determined for the desired performance.

FIG. 11 illustrates a 3-stage fluid flow device according to another embodiment of the invention. The view is taken from the rotor shaft. The device comprises a fluid inlet 70 and fluid outlet 72 at each end of a substantially cylindrical shroud 74. Three rotors 76 and two stators 78 are arranged alternately as shown. The rotors are mounted on a common shaft driven by a motor or some other means. The shaft and motor are not visible in the drawing. The stators 78 are integrally assembled to the shroud. Only one each of rotor bubble 80 and stator bubble 82 are shown for clarity. These bubbles form fluid passages in the rotors and stators. The bubbles are of course same as the scoop and exhaust cups on the rotors and the inlet and outlet cups on the stators. The relative locations of rotor and stator bubbles are also exemplary only. The fluid flows to be generated at various stages upon rotating the rotor are also depicted by arrows. The labyrinth seals between the rotors and the shroud are used to minimize the back flow. The labyrinth seals shown serve as an example only. More elaborate labyrinth seals can be employed to further minimizing the back flow.

As mentioned earlier, the shroud is an axially symmetrical body such as a cylinder, increasing frustum (cone), decreasing frustum, increasingly or decreasingly stepped cylinders etc. Therefore in yet a further embodiment, the shroud, the rotors and the stators increase in diameters progressively from one end of the fluid flow device to the other.

The operation of the 3-stage fluid flow device of FIG. 11 will be described in detail below. It should however be noted that a single or other multistage device and a device with only a rotor are similar in operation with the 3-stage fluid flow device.

Referring to FIG. 11, the rotors are assembled coaxially with the stators with minimum clearances from the shroud wall or with a specially designed seals to minimize the back flow. Seals are also provided between the rotor shaft and the stators. The rotor rotates at high speed in a direction shown by an arrow 84 for the bubble arrangement shown in the figure. The fluid enters the bubble from the top and exits from the other side of the disc. The speed of the fluid exiting the rotor is reduced upon contacting the stator below it, raising the pressure in the region enclosed by the rotor and the stator.

If the fluid is a gas, while higher compression ratio for the gas on the opposite sides of the rotor develops at supersonic translational velocities of the bubbles when the bubble design is optimized for such high speeds, the device operates efficiently also at transonic and subsonic velocities albeit at reduced compression ratios.

While stator could be a flat circular plate with perforations to allow fluid to flow through, it can be designed to help in further boosting the fluid pressure as it travels through the stator. Thus the rotor downstream of the stator sees a higher pressure fluid than the upstream rotor. Like the first rotor, the fluid enters the bubbles in the second rotor from the top and is stopped by the second stator, increasing the fluid pressure further. Similar actions are repeated at each successive stages before the fluid exits at the outlet 72.

In a way of a further embodiment, FIG. 12 illustrates schematically a gas turbine power plant which uses rotors and stators made according to the teaching of the present invention. Similar to FIG. 11, multistage rotor-stator are provided in a shroud 90. Unlike the axial compressor which converts power applied on the rotor shaft to high speed fluid flow, the power plant generates power at the rotor shaft (not shown) when high speed fluid flow 92 is applied to the rotor to rotate in the direction shown by an arrow 94. The high speed fluid flow is created by a variety of mechanisms, such as combustion, gas ignition, hydrostatic and electric potentials etc. The rotors and stators are made in a similar fashion, that is to say, by assembling two or more discs with properly located bubbles 96 and 98. Unlike those in the rotor of the compressor, bubbles in the rotors of the power plant are shaped to capture energy more efficiently in the fast moving fluid. FIG. 12 depicts one example for the shape of bubbles. At any rate, compared to individual blade configuration, rotors and stators as shown in FIG. 12 are far more stable, sturdy and rugged in construction.

As mentioned earlier, the current invention completely dispenses with the individual blade concept in favour of a flat thin disc with open narrow bubbles, acting as scoops, formed/stamped directly into the disc. The bubble configuration is applicable for compressors as well as power plants. These bubbles are readily visualized by looking at the bubbles found in an ordinary household cheese grater. The shape and size of bubbles in the rotors and stators can be optimized. Because the bubbles are small and interconnected through the disc material this structure is far more rigid than the individual cantilevered blades of conventional axial compressors. Moreover, a bubble is aerodynamically much more tolerant of unsteadiness in the flow than a blade because each bubble has its own built-in fence 'so to speak' which limits the radial flow and makes each bubble relatively less sensitive to adjacent bubbles along the same radius. While a pair of discs and plates are described to form integral rotors and stators, more than two discs and plates may be used to form them for any reasons such as more strength, rigidity, etc. Of course middle discs and plates must have matching cut-out to form desired fluid passages.

The bubbles are designed as small aspect ratio wings (pockets) to yield higher compression ratio per stage. Furthermore, with this arrangement the periphery of the rotor disc is amenable to integrating with more effective labyrinth seals than would be possible with conventional bladed rotors and to do so with virtually little or no additional cost.

Apart from the simplicity and greater structural strength of the disc with bubbles over individual blades configuration a substantial performance improvement in terms of pressure ratio increase/stage at equivalent volumetric flow rate is achievable.

Apart from being an entirely new approach for axially compressing fluids, the new device can be built simply by stamping sheet metal and thus can be manufactured in large quantities at very low cost making its use feasible in consumer and commercial application in addition to industrial aeronautical, and spacecraft applications.

THEORETICAL CONSIDERATIONS

Theoretical considerations are presented below assuming incompressible fluid flow.

Bernoulli's Equation for an ideal gas in incompressible flow is $$P_\infty + \frac{1}{2}\rho_\infty V_\infty^2 = P_1 + \frac{1}{2}\rho_1 V_1^2 \tag{1}$$

$$P_1 - P_\infty = \frac{1}{2}\rho_\infty V_\infty^2 - \frac{1}{2}\rho_1 V_1^2$$

$$\frac{P_1}{P_\infty} = 1 + \frac{q_\infty}{P_\infty}\left(1 - \frac{\rho_1}{\rho_\infty}\frac{V_1^2}{V_\infty^2}\right), \text{ where } q_\infty = \frac{1}{2}\rho_\infty V_\infty^2$$

and, for $V_1 < 0.3V_\infty$, $$\frac{V_1^2}{V_\infty^2} \ll 1 \therefore \frac{P_1}{P_\infty} \cong 1 + \frac{q_\infty}{P_\infty} \cong \left(1 + \frac{\rho_\infty}{2P_\infty}V_\infty^2\right) \tag{2}$$

In the equations above and those following, "∞" denotes conditions ahead of rotor and "1" denotes conditions downstream of rotor. P, ρ, and V designate pressure, density and velocity respectively.

To a first approximation, therefore, the pressure ratio $$\frac{P_1}{P_\infty}$$

remains unaffected by the initial level of the ambient pressure so long as $$\frac{\rho_\infty}{P_\infty}$$

remains constant which is the case for an ideal gas where $$\frac{P_\infty}{\rho_\infty} = RT_\infty$$

and $T_\infty$ is the absolute temperature assumed to remain almost constant. R is the universal gas constant.

It is also observed from equation (2) that the pressure ratio increases with increase in $V_\infty^2$.

Figure 13:
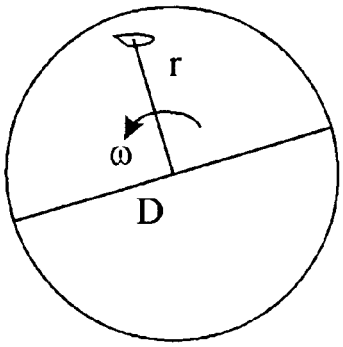
FIG. 13 is an illustration of a rotor showing parameters which are used in consideration.
Figure 14:
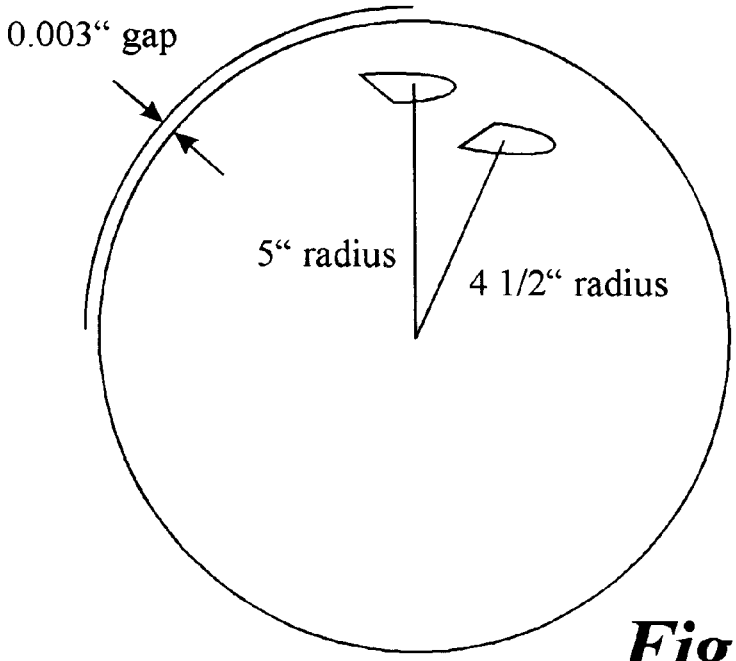
FIG. 14 shows locations of bubbles and a gap between the rotor and the shroud.
Figure 15:
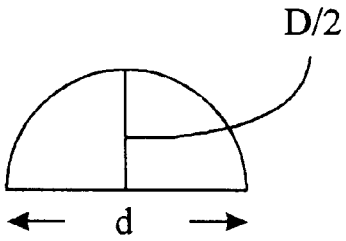
FIG. 15 depicts parameters of a bubble (cups) used for theoretical consideration.

Various cases have been worked out for a rotating disc thus far described. The disc and some parameters are shown in FIGS. 13–15, in which r is the radial location of bubble, $f$ is the revolutions/sec (RPM/60), $V_1$ is the velocity of the fluid after passing through disc (bubble), d is a diameter of a bubble and D is a diameter of the disc. A gap between the disc and shroud is also shown.

For the disc in the figures, the fluid velocity at the upstream side of the disc is expressed:

$$V_\infty = r\omega = 2\pi f r$$

For the case where r=5"=(5/12)', $\rho_\infty$=0.002378 SLUGS/ft$^3$, and $P_\infty$=14.7psi (air), results for RPM=3000–30000 have been tabulated in the table below. In the table, results also include other parameters, such as volumetric flow rate V(ft$^3$/min) and leakage flow rate L(ft$^3$/min), both of which will be described in detail below.

TABLE

| RPM x1000 | $V_\infty$(ft/sec) $2\pi\frac{RPM}{60}\frac{5}{12}$ | $q_\infty$(lb/ft$^2$) $\frac{1}{2}\rho_\infty V_\infty^2$ | $P_1/P_\infty$ $0 < \frac{V_1}{V_\infty} < 0.3$ | V(ft$^3$/min) $V_\infty = 2\pi fr$, $r = \frac{5}{12}$ft, n = 8, $V_1 = 0.1V_\infty$ | V(ft$^3$/min) for $V_1 = 0.3\ V_\infty$ | L(ft$^3$/min) gap = 0.003" |
|---|---|---|---|---|---|---|
| 3 | 125 | 18.75 | 1.008 | 2.15 | 6.45 | 0.6 |
| 6 | 250 | 75.00 | 1.032 | 4.30 | 12.90 | 1.2 |
| 9 | 375 | 168.75 | 1.072 | 6.45 | 19.35 | 1.8 |
| 12 | 500 | 300.00 | 1.128 | 8.6 | 25.8 | 2.4 |
| 15 | 625 | 468.75 | 1.200 | 10.75 | 32.25 | 3.0 |
| 18 | 750 | 675.00 | 1.268 | 12.90 | 38.70 | 3.6 |
| 21 | 875 | 918.75 | 1.392 | 15.05 | 45.15 | 4.2 |
| 24 | 1000 | 1200.00 | 1.512 | 17.20 | 51.60 | 4.8 |
| 27 | 1125 | 1508.75 | 1.648 | 19.35 | 58.05 | 5.4 |
| 30 | 1250 | 1875.00 | 1.800 | 21.50 | 64.50 | 6.0 |

Volumetric Flow

Volumetric flow rate V(ft$^3$/min) is given by the following formula:

$$V = A * n * V_1 * 60$$

where:

A=frontal area of bubble projected in circumferential direction in ft$^3$.

$V_1$=fluid velocity in ft/sec on high pressure side (downstream) of bubble following compression in the bubble.

n=number of bubbles.

For case shown in FIGS. 13 and 14

$$V = \pi\frac{\left(\frac{3}{16}\right)^2}{2} \times \left(2\pi\frac{RPM}{60} * \frac{5}{12}\right)\frac{1}{10} \times 8 \times 60 = 0.1157 \times RPM$$

(ft3/min)=(cross-sectional area)*($V_\infty$/10)*(number of bubbles)*(60 seconds)

Leakage Flow

Leakage flow is a back flow through gaps between disc and the wall of shroud. The flow through the periphery of the rotor will discharge at the maximum speed from pressure $P_1$(stagnation) to pressure $P_\infty$ prior to compression. Leakage flow rate L(ft$^3$/min) is therefore expressed as below:

$$L = \pi D \times \text{gap size} \times V_\infty \times 60$$

For case shown in FIGS. 12 and 13

$$L(\text{ft}^3/\text{min}) = \pi \times \frac{12}{12} \times \frac{0.003}{12} \times 2 \times \pi \times RPM \times \frac{5}{12} = 0.002 \times RPM$$

Figure 16:
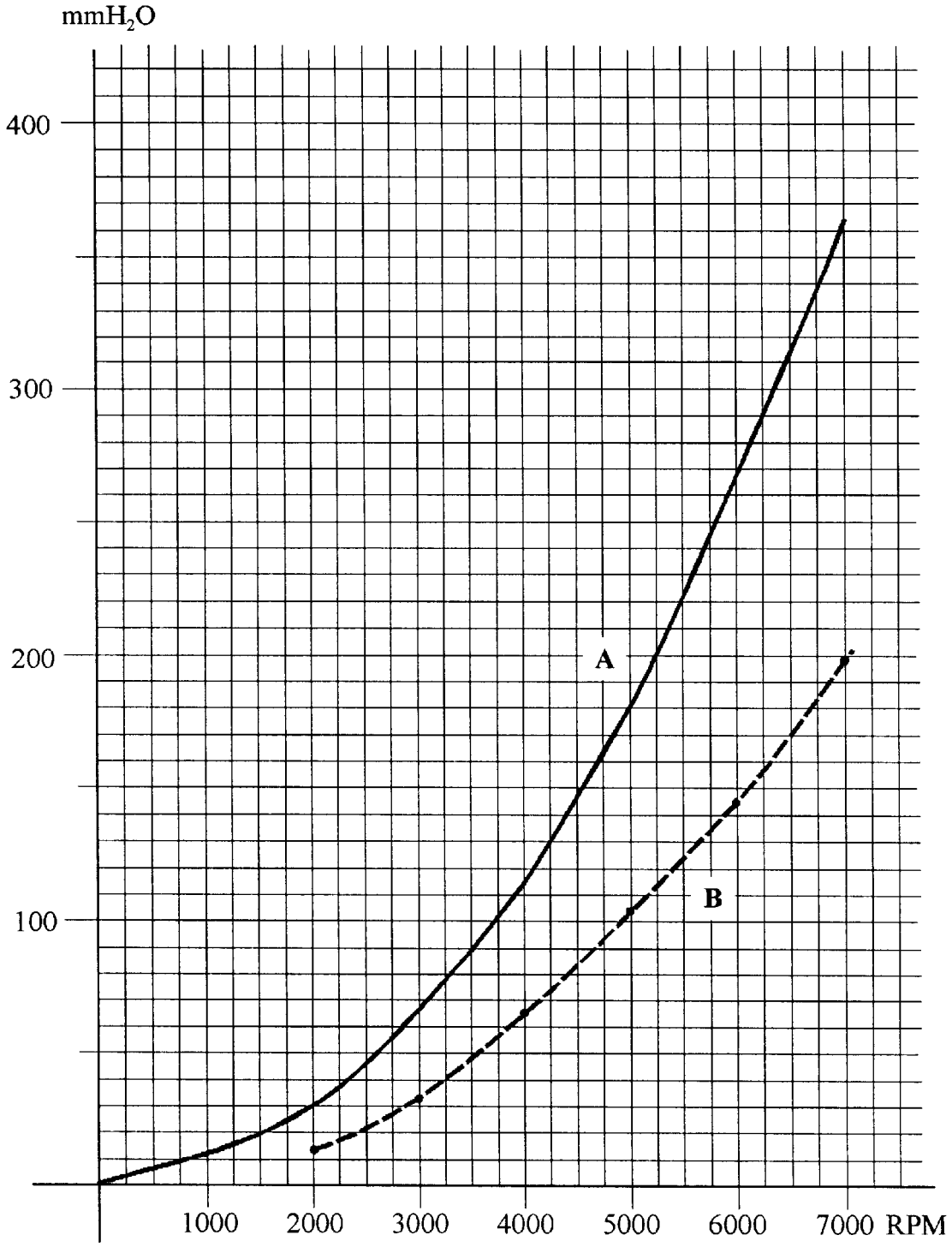
FIGS. 16, 17 and 18 are graphs showing comparisons between theoretical estimates and experimental measurements of certain parameters.
Figure 17:
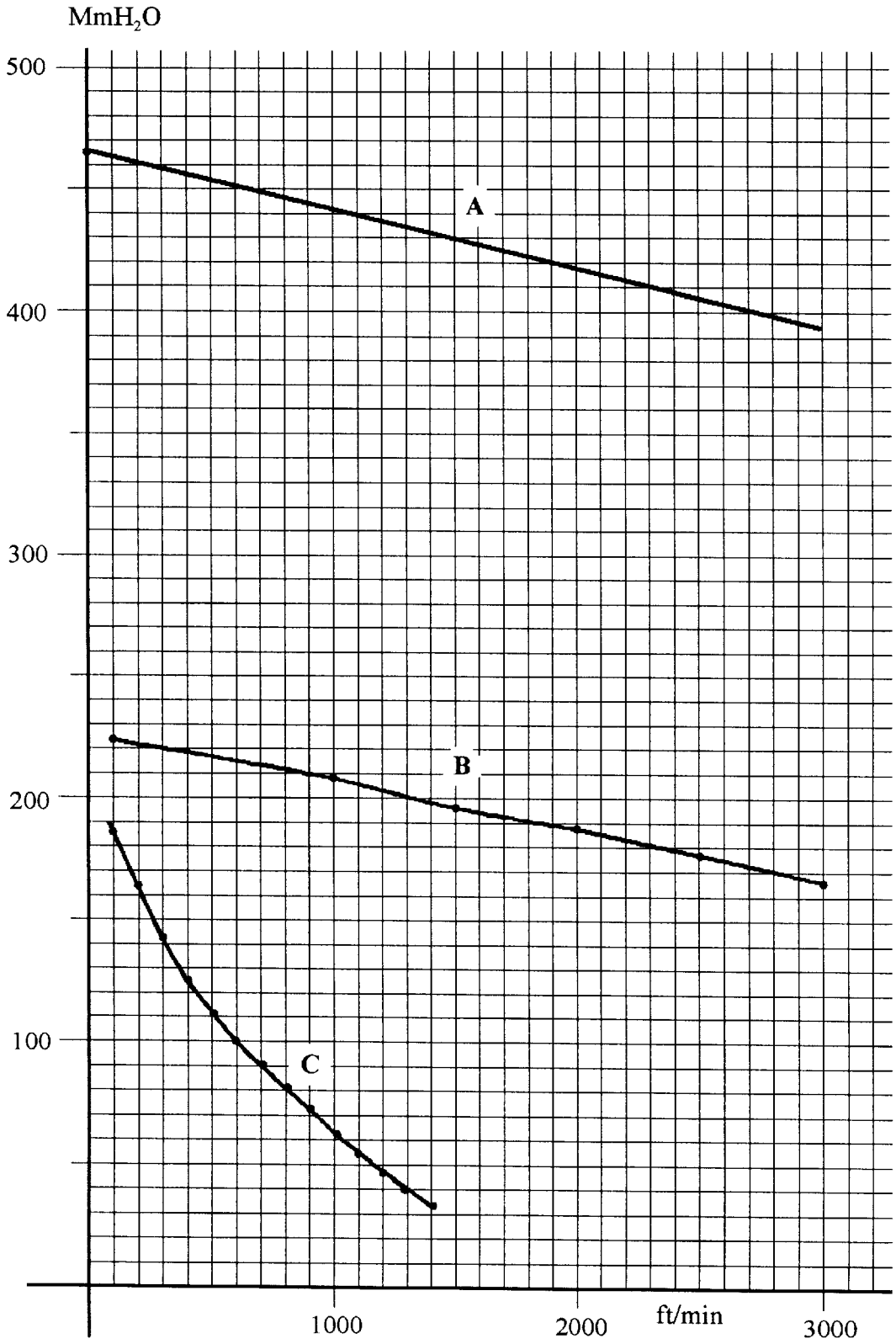
Figure 18:
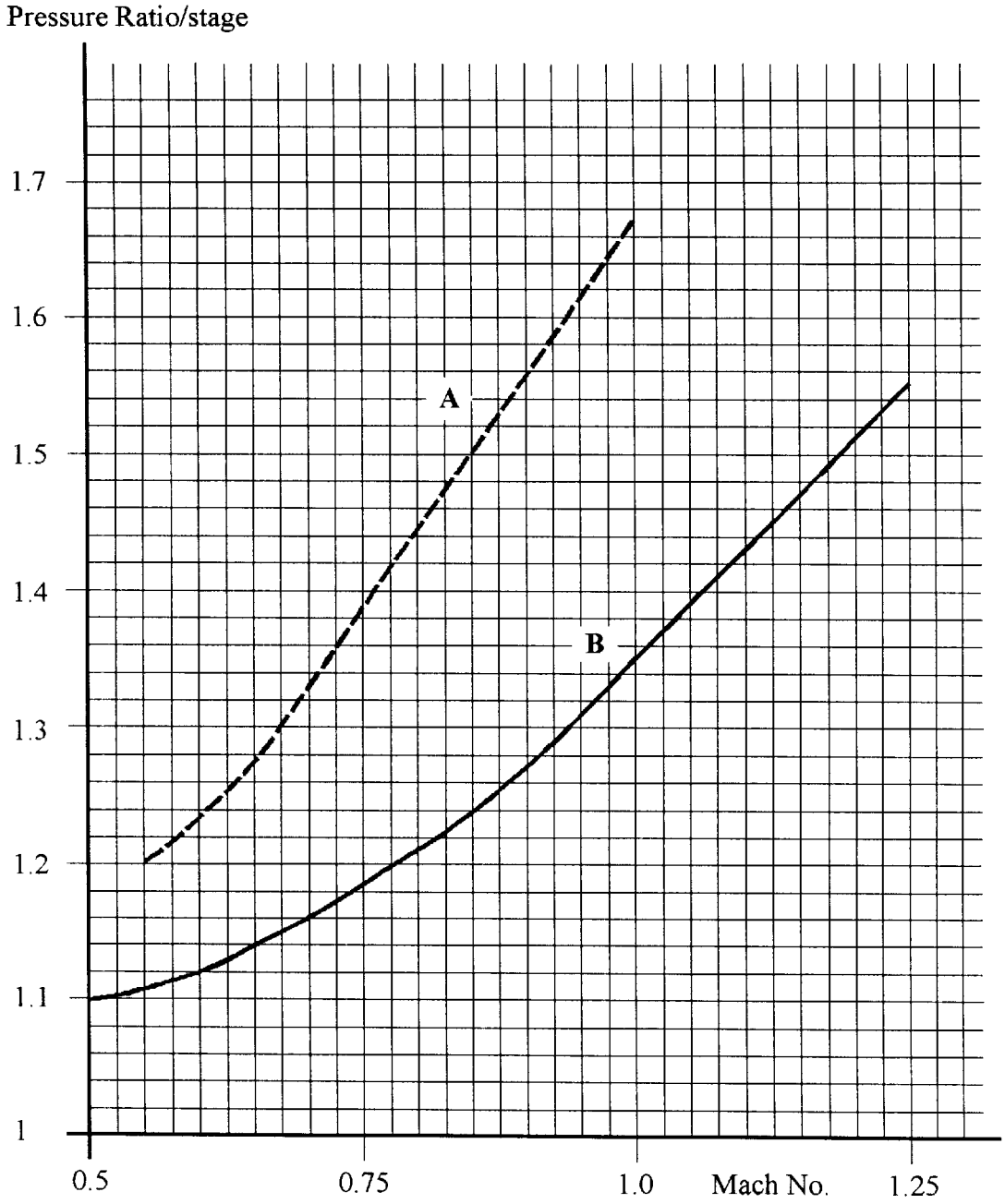

FIGS. 16–18 are graphs showing comparisons between theoretical estimates and experimental measurements of certain parameters. In particular, FIG. 16 shows the pressure rise (vertical axis in mm$H_2O$) versus the rotational speed (horizontal axis in Revs/min). Line A is a theoretical ideal case for a disc with bubbles located at 4⅜" radius with no leakage. Line B is experimental measurements for a single disc with 48 bubbles in two rows. The outer row is at 5" radius and inner row is at 4½" radius (minimum radius of 4⅜" being the inside edge of the inner row of bubbles).

FIG. 17 shows the pressure drop (vertical axis in mm$H_2O$) versus the through flow velocity (horizontal axis in ft/min) through an orifice (3⅜" diameter). Line A is a probable theoretical case based on $$\frac{P_1}{P_\infty} = 1.045$$

at 7000 RPM with no leakage. Line B is experimental measurements for a single plate with 48 bubbles (in total) in two rows. There are 24 bubbles on the outer circle at 5" radius and 24 bubbles on the inner circle at 4½" radius. Line C is also experimental measurements for a case of double plates (two plates integrally contacted back-to-back) with 8 bubbles each at 5" radius. This rotor therefore has scoop cups and exhaust cups.

FIG. 18 shows a comparison in terms of pressure ratio between theoretical values of the present invention with ideal seal in incompressible flow (line A) and a modern bladed compressor per stage (line B). In FIG. 18, the vertical axis is stage pressure ratio and the horizontal axis is fluid velocity in Mach number.

Figure 19:
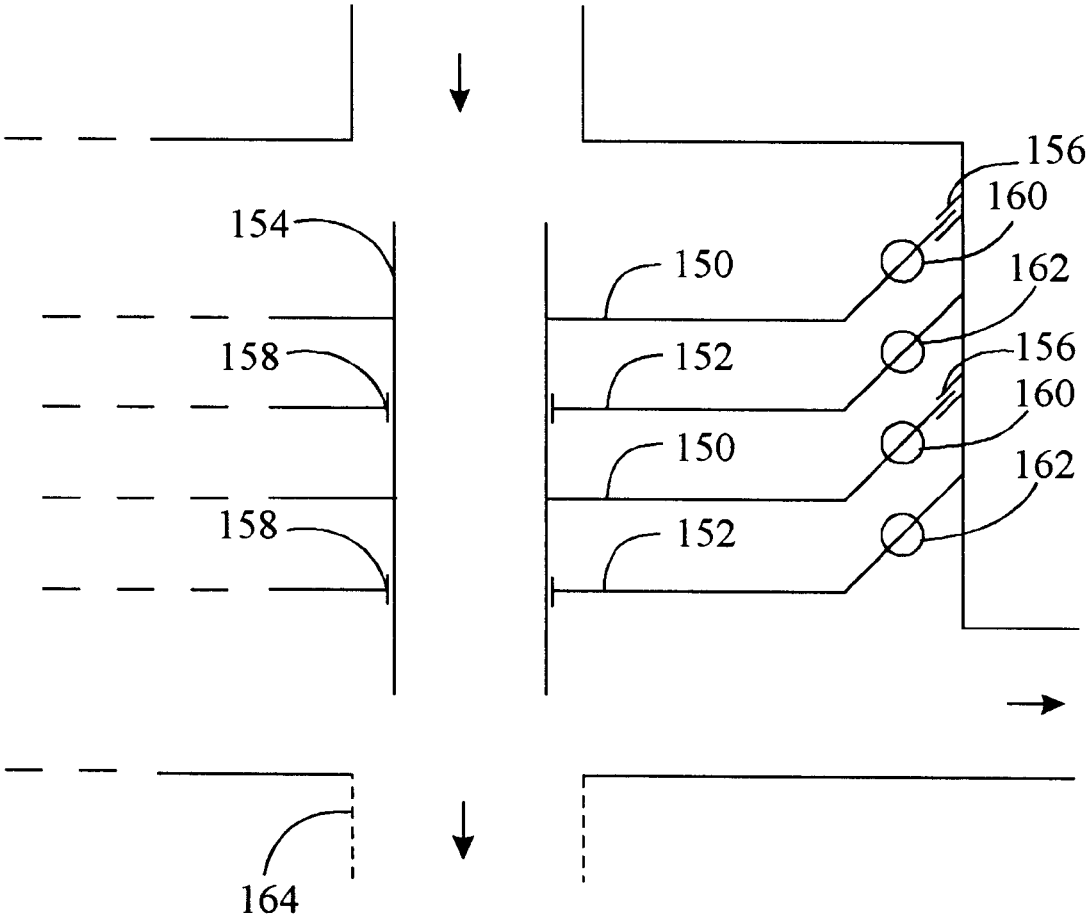
FIGS. 19, 20 and 21 are side views of multi-stage fluid flow device according to yet further embodiments of the invention.
Figure 20:
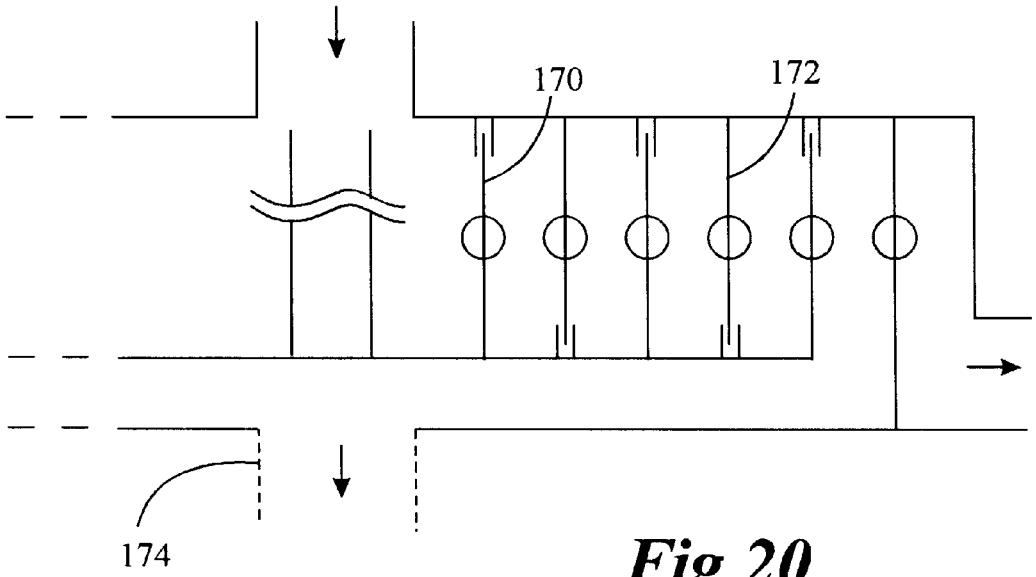
Figure 21:
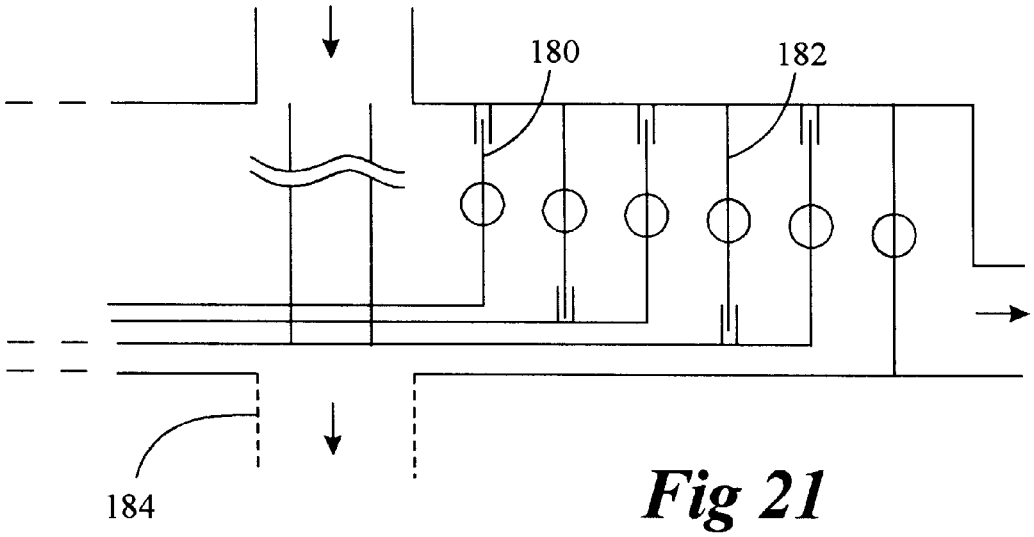

FIGS. 19–21 depict multi-stage fluid flow machines in accordance with yet further embodiments of the invention. In the Figures, the rotors and stators are shaped so that bubbles are located at angles with the plane of rotation. Fluid flows in these machines are transversal rather than axial. In FIG. 19, two rotor discs 150 and two stator discs 152 are provided. The rotor discs are attached on a rotatable shaft 154. Seals 156 on the rotor discs and seals 158 on the stator discs maintain fluid tightness upon rotation of the rotor. As shown in the figure, the rotor and stator discs have peripheral parts at angles with the remaining parts of the discs. Rotor bubbles 160 and stator bubbles 162 are located at such peripheral parts. Referring to FIGS. 20 and 21, the peripheral parts 170, 172, 180 and 184 of the rotor and stator discs are at a more acute angle (e.g., 90 degree) with the remaining parts of the discs. The figures clearly show locations of bubbles and seals, as well as inlets and outlets, alternative outlets 164, 174 and 184 being shown in dotted lines. Like embodiments discussed earlier, similar arrangements shown in FIGS. 19–21 perform as a power plant or a compressor with appropriate modifications of bubbles.

Following design features can be considered for desired performances:

1. Place the bubble as close as possible to the periphery of the rotor but not so close as to create too much drag due to proximity to wall boundary.
2. Minimize the gap between the rotor edge and the wall
3. Make the bubble inlet diameter (d) as large as possible.
4. Beneficially stagger and shape the inlet of the bubbles to create more of a scoop effect.

What we claim as our invention is:

1. A fluid flow device, comprising:

a shroud having a fluid inlet at one end and a fluid outlet at the other end and defining a general direction of a fluid flow from the fluid inlet to the fluid outlet;

a central shaft located substantially coaxially with the shroud;

a rotor integrally attached to the central shaft for rotation therewith within the shroud in a substantially fluid tightness fashion;

the rotor having one or more open-ended scoop cups on an upstream surface and near the circumference of the rotor, each open-ended scoop cup defining a fluid passage through the rotor, and;

the open-ended scoop cups being shaped and sized for converting power between the fluid flow and the rotor.

2. The fluid flow device according to claim 1, further comprising:

the rotor having one or more open-ended exhaust cups on a downstream surface, and near the circumference the rotor, each scoop cup and exhaust cup together defining a fluid passage through the rotor; and the scoop cups and the exhaust cups are shaped and sized in such a way for converting power between the fluid flow and the rotor.

3. The fluid flow device according to claim 2, further comprising:

a seal between the shroud and the perimeter of the rotor to allow a rotation of the rotor, while maintaining a substantial fluid tightness.

4. The fluid flow device according to claim 3, further comprising:

one or more rotors and stators, alternately and coaxially located inside the shroud, substantially in parallel and adjacent to one another; and each stator attached to the shroud at its perimeter and having one or more fluid passages therethrough, the fluid passages of the stator being shaped and sized to create desired fluid flows downstream.

5. The fluid flow device, according to claim 4, wherein each stator further comprises one or more open-ended inlet cups on its upstream surface and one or more open-ended outlet cups on its downstream surface, each inlet cup and outlet cup together defining one of the fluid passages through the stator.

6. The fluid flow device, according to claim 3, wherein the rotor having two or more discs attached to one another to form an integral rotor, one disc having one or more cut-outs forming the open-ended scoop cups and another disc having one or more cut-outs forming the open-ended exhaust cups.

7. The fluid flow device, according to claim 5, wherein each rotor having two or more discs attached to one another to form an integral rotor, one disc having one or more cut-outs forming the open-ended scoop cups and another disc having one or more cut-outs forming the open-ended exhaust cups and each stator having two or more plates attached to one another to form an integral stator, one plate having one or more open-ended inlet cups and another plate having one or more open-ended outlet cups.

8. The fluid flow device according to claim 3, wherein the scoop cups and exhaust cups are arranged in one or more circles near the perimeter of the rotor; and are substantially in the shape of cheese grater.

9. The fluid flow device according to claim 5, wherein the scoop cups and exhaust cups are arranged in one or more circles near the perimeter of the rotor; and the scoop cups, exhaust cups, inlet cups and outlet cups are all substantially in the shape of cheese grater.

10. The fluid flow device according to claim 6, wherein the scoop cups and exhaust cups are arranged in one or more circles near the perimeter of the rotor; and are substantially in the shape of cheese grater.

11. The fluid flow device according to claim 7, wherein the scoop cups and exhaust cups are arranged in one or more circles near the perimeter of the rotor; and the scoop cups, exhaust cups, inlet cups and outlet cups are all substantially in the shape of cheese grater.

12. The fluid flow device for generating a fluid flow, according to claim 8, wherein the shroud is of an axially symmetrical shape, such as a cylinder, a tapered cylinder, and stepped cylinder.

13. The fluid flow device for generating a fluid flow, according to claim 9, wherein the shroud is of an axially symmetrical shape, such as a cylinder, a tapered cylinder, and stepped cylinder.

14. The fluid flow device for generating a fluid flow, according to claim 10, wherein the shroud is of an axially symmetrical shape, such as a cylinder, a tapered cylinder, and stepped cylinder.

15. The fluid flow device for generating a fluid flow, according to claim 11, wherein the shroud is of an axially symmetrical shape, such as a cylinder, a tapered cylinder, and stepped cylinder.

16. The fluid flow device according to claim 1, further comprising:

a power source for rotating the rotor about the central shaft; and the scoop cups being shaped and sized in such a way that upon rotation of the rotor in one direction, the fluid flow is generated through the shroud.

17. The fluid flow device according to claim 3, further comprising:

a power source for rotating the rotor about the central shaft; and the scoop cups and the exhaust cups are shaped and sized in such a way that upon rotation of the rotor in one direction, the fluid flow is generated through the shroud.

18. The fluid flow device according to claim 4, further comprising:

a power source for rotating integrally one or more rotors about the central shaft; and the scoop cups and the exhaust cups are shaped and sized in such a way that upon rotation of the rotor in one direction, the fluid flow is generated through the shroud.

19. The fluid flow device for generating a fluid flow, according to claim 16, wherein each fluid passage in the rotor is substantially a straight line.

20. The fluid flow device for generating a fluid flow, according to claim 17, wherein each fluid passage in the rotor is substantially a straight line from the scoop cup to the exhaust cup.

21. The fluid flow device for generating a fluid flow, according to claim 18, wherein each fluid passage in the rotor is substantially a straight line from the scoop cup to the exhaust cup, and each fluid passage in the stator has a bend.

22. The fluid flow device for generating a fluid flow, according to claim 20, wherein the shroud is of an axially symmetrical shape, such as a cylinder, a tapered cylinder, and stepped cylinder.

23. The fluid flow device for generating a fluid flow, according to claim 21, wherein the shroud is of an axially symmetrical shape, such as a cylinder, a tapered cylinder, and stepped cylinder.

24. The fluid flow device according to claim 1, further comprising:

an energy source for generating the fluid flow in the shroud, the energy source including any of gas combustion, explosion, hydrostatic and electrical potential, and the scoop cups being shaped and sized in such a way for capturing power from the fluid flow to drive the rotor and the central shaft.

25. The fluid flow device according to claim 3, further comprising:

an energy source for generating the fluid flow in the shroud, the energy source including any of gas combustion, explosion, hydrostatic and electrical potential, and the scoop cups and exhaust cups being shaped and sized in such a way for capturing power from the fluid flow to drive the rotor and the central shaft.

26. The fluid flow device according to claim 4, further comprising:

an energy source for generating the fluid flow in the shroud, the energy source including any of gas combustion, explosion, hydrostatic and electrical potential, and the scoop cups and exhaust cups being shaped and sized in such a way for capturing power from the fluid flow to drive integrally one or more rotors and the central shaft.

27. The fluid flow device according to claim 24, wherein each fluid passage in the rotor has a bend.

28. The fluid flow device according to claim 25, wherein each fluid passage in the rotor has a bend between the scoop cup and the exhaust cup.

29. The fluid flow device according to claim 26, wherein each fluid passage in the rotor has a bend between the scoop cup and the exhaust cup, and each fluid passage in the stator has a bend.

30. The fluid flow device for generating a fluid flow, according to claim 28, wherein the shroud is of an axially symmetrical shape, such as a cylinder, a tapered cylinder, and stepped cylinder.

31. The fluid flow device for generating a fluid flow, according to claim 29, wherein the shroud is of an axially symmetrical shape, such as a cylinder, a tapered cylinder, and stepped cylinder.

* * * * *